US011685619B1

(12) United States Patent
Tsukasaki

(10) Patent No.: US 11,685,619 B1
(45) Date of Patent: Jun. 27, 2023

(54) PAPER FEEDING DEVICE AND PAPER FEEDING METHOD

(71) Applicant: Masahiro Tsukasaki, Osaka (JP)

(72) Inventor: Masahiro Tsukasaki, Osaka (JP)

( * ) Notice: Subject to any disclaimer, the term of this patent is extended or adjusted under 35 U.S.C. 154(b) by 0 days.

(21) Appl. No.: 17/991,155

(22) Filed: Nov. 21, 2022

(51) Int. Cl.

| | |
|---|---|
| ***B65H 1/06*** | (2006.01) |
| ***B65H 3/06*** | (2006.01) |
| ***B65H 3/04*** | (2006.01) |
| ***B65H 3/54*** | (2006.01) |
| ***B65H 3/68*** | (2006.01) |
| ***B65H 3/52*** | (2006.01) |
| ***B65H 3/34*** | (2006.01) |

(52) U.S. Cl.
CPC ..... *B65H 1/06* (2013.01); *B65H 3/042* (2013.01); *B65H 3/047* (2013.01); *B65H 3/063* (2013.01); *B65H 3/0692* (2013.01); *B65H 3/34* (2013.01); *B65H 3/5246* (2013.01); *B65H 3/54* (2013.01); *B65H 3/68* (2013.01); *B65H 2511/214* (2013.01)

(58) Field of Classification Search
CPC . B65H 1/06; B65H 1/26; B65H 3/042; B65H 3/063; B65H 3/0692; B65H 3/122; B65H 3/34; B65H 3/68; B65H 11/002; B65H 2511/214
See application file for complete search history.

(56) References Cited

U.S. PATENT DOCUMENTS

| | | | | |
|---|---|---|---|---|
| 4,657,236 A * | 4/1987 | Hirakawa | ..... | B65H 3/085 271/99 |
| 4,889,331 A * | 12/1989 | Sardella | ..... | B65H 3/063 271/118 |
| 4,896,872 A * | 1/1990 | Sardella | ..... | B65H 3/063 271/118 |
| 5,172,898 A * | 12/1992 | Takahashi | ..... | B65H 3/063 414/797.7 |
| 10,407,261 B2 | 9/2019 | Tsukasaki | | |

FOREIGN PATENT DOCUMENTS

| | | |
|---|---|---|
| JP | H0286346 | 3/1990 |
| JP | H07117935 | 5/1995 |
| JP | 2001-253576 | 9/2001 |
| JP | 2002-362761 | 12/2002 |
| JP | 2016-050071 | 4/2016 |

* cited by examiner

*Primary Examiner* — Prasad V Gokhale
(74) *Attorney, Agent, or Firm* — Leonid Kisselev

(57) ABSTRACT

A paper feeding device 100 includes a support hook 5 that supports a lower edge of a front side of a bundle of stacked paper sheets X, and a paper trailing edge storing part 32 provided between a lower end of the abutting surface 31 and the paper feeding table 11, and the paper feeding device retracts the lowermost layer paper sheet of the loaded paper sheets so as to store its trailing edge in the paper trailing edge storing part 32 and then advance it.

6 Claims, 5 Drawing Sheets

PAPER FEEDING DEVICE AND PAPER FEEDING METHOD

FIELD

The present invention relates to a paper feeding device that feeds paper materials one by one to a printing device, a punching device, or the like, and a paper feeding method, and particularly relates to a paper feeding device that feeds thin paper, and a paper feeding method.

BACKGROUND

Conventionally, as a paper feeding device that feeds paper to a printing machine or the like, a paper feeding device that feeds paper materials one by one from a lower side with a roller is widely used, the paper materials being loaded along a guide plate vertically provided above a paper feeding table with the downstream side edges abutting on the guide plate (see, for example, Japanese Patent Laid-Open No. 2016-50071).

In Japanese Patent Laid-Open No. 2016-50071, a paper feeding device 9 (see FIG. 6) feeds thick paper sheets X such as cardboard sheets and is configured to convey downstream, with a paper feeding roll 13, a lowermost layer paper sheet X1 of the thick paper sheets X loaded between a guide plate 902 and a back guide 905, through a gap 22 between a paper feeding table 11 and the guide plate 902, while suctioning the lowermost layer paper sheet X1 downward through a suction hole 12 provided in the paper feeding table 11.

In the paper feeding device 9 of Japanese Patent Laid-Open No. 2016-50071, however, a height of the gap 22 is adjusted to pass only one sheet of thick paper X through the gap, but there is a problem that, in a case where paper is thin, it is difficult to adjust the height of the gap 22 so as to pass only one sheet of paper through the gap.

An object of the present invention, which has been made in view of the above problem, is to provide a paper feeding device capable of feeding even thin paper by separately feeding paper sheets one by one.

SUMMARY

The present invention made to solve the above problem provides a paper feeding device, the paper feeding device including: a paper feeding table onto which a bundle of stacked paper sheets is loaded in a thickness direction aligned with an up-down direction; a guide plate that is vertically provided above the paper feeding table, to abut on a leading edge of each paper sheet in the bundle; a back guide including an abutting surface that abuts on a trailing edge of the paper sheets in the bundle; a suction hole through which each loaded paper sheet on the paper feeding table is suctioned downward; a suction pump that supplies a negative pressure to the suction hole; a paper feeding conveyor included in the paper feeding table and including one of a paper feeding roll or a belt conveyor and moving each paper sheet loaded onto the table one of forward or rearward in a paper feeding direction; a servo motor that rotationally drives the paper feeding conveyor; a support piece that supports a lower edge of a front side of the bundle of the stacked paper sheets in a state where the lower edge is separated from the paper feeding table; a paper trailing edge storing part including a gap provided between a lower end of the abutting surface of the back guide and the paper feeding table; and a control unit that controls the servo motor and the suction pump, wherein the control unit controls the servo motor and the suction pump to retract the paper sheet that is in a lowermost layer of the stacked paper sheets in the bundle so as to store a trailing edge of the lowermost layer paper sheet in the paper trailing edge storing part and then advance the lowermost layer paper sheet through the gap to feed the lowermost layer paper sheet to another device, while suctioning the lowermost layer paper sheet with the suction pump.

According to the paper feeding device of the present invention, in this way, the lower edge of the front side of the bundle of loaded paper sheets is supported on the support piece so that the lower edge is separated from the paper feeding table, and the lowermost layer paper sheet of the loaded paper sheets is retracted and then advanced while being suctioned downward. Therefore, even thin paper sheets can be separately fed one by one, and a plurality of sheets can be prevented from being accidentally conveyed.

In the paper feeding device of present invention, it is preferable that the back guide has a collision surface provided behind the paper trailing edge storing part, and the control unit controls the servo motor so that the lowermost layer paper sheet sent rearward abuts on the collision surface and then the lowermost layer paper sheet is conveyed forward in the paper feeding direction.

Thus, the collision surface is provided behind the paper trailing edge storing part, and the lowermost layer paper sheet sent rearward abuts on the collision surface and is then conveyed forward in the paper feeding direction, so that a space between paper sheets to be fed in a transport direction can be accurately aligned.

It is preferable that the support piece has a tip inclined downward. Thereby, the paper to be fed easily comes off rearward.

It is preferable that an angle between an upper surface of the support piece and a guide surface of the guide plate that abuts on a leading edge of the paper sheet is 80 degrees or more and 100 degrees or less. This can inhibit the loaded paper sheets from being scattered.

The present invention provides a paper feeding method for feeding paper sheets, including: loading paper sheets, wherein the paper sheets are loaded in a thickness direction aligned with an up-down direction, by use of a paper feeding device, the paper feeding device including: a paper feeding table onto which a bundle of the stacked paper sheets is loaded; a guide plate that is vertically provided above the paper feeding table, to abut on a leading edge of the paper sheets in the bundle; a back guide having an abutting surface that abuts on a trailing edge of the paper sheets in the bundle; a suction hole through which each loaded paper sheet is suctioned downward; a suction pump that supplies a negative pressure to the suction hole; a paper feeding conveyor included in the paper feeding table and including one of a paper feeding roll or a belt conveyor that moves each paper sheet loaded onto the table one of forward or rearward in a paper feeding direction; a servo motor that rotationally drives the paper feeding conveyor; a support piece that supports a lower edge of a front side of the bundle of the stacked paper sheets in a state where the lower edge is separated from the paper feeding table, and a paper trailing edge storing part including a gap provided between a lower end of the abutting surface of the back guide and the paper feeding table; and retracting, by the servo motor, the paper sheet that is in a lowermost layer of the stacked paper sheets in the bundle so as to store a trailing edge of the lowermost layer paper sheet in the paper trailing edge storing part, and then advancing the lowermost layer paper sheet through the gap to feed the lowermost layer paper sheet to the another device, while suctioning, by the suction pump, the lowermost layer paper sheet of the loaded paper sheets.

According to present invention, in the paper feeding method, it is preferable that in the paper feeding device, the back guide has a collision surface provided behind the paper trailing edge storing part, the serve motor allows the lowermost layer paper sheet sent rearward to abut on the collision surface, and then the servo motor conveys the lowermost layer paper sheet forward in the paper feeding direction.

As described above, according to the paper feeding device and the paper feeding method of present invention, even thin paper sheets can be separately fed one by one, and a plurality of sheets can be inhibited from being accidentally conveyed while being overlapped.

DETAILED DESCRIPTION

Hereinafter, an embodiment of the present invention will be described in detail using the drawings as appropriate. However, the present invention is not limited to the following embodiment.

Figure 1:
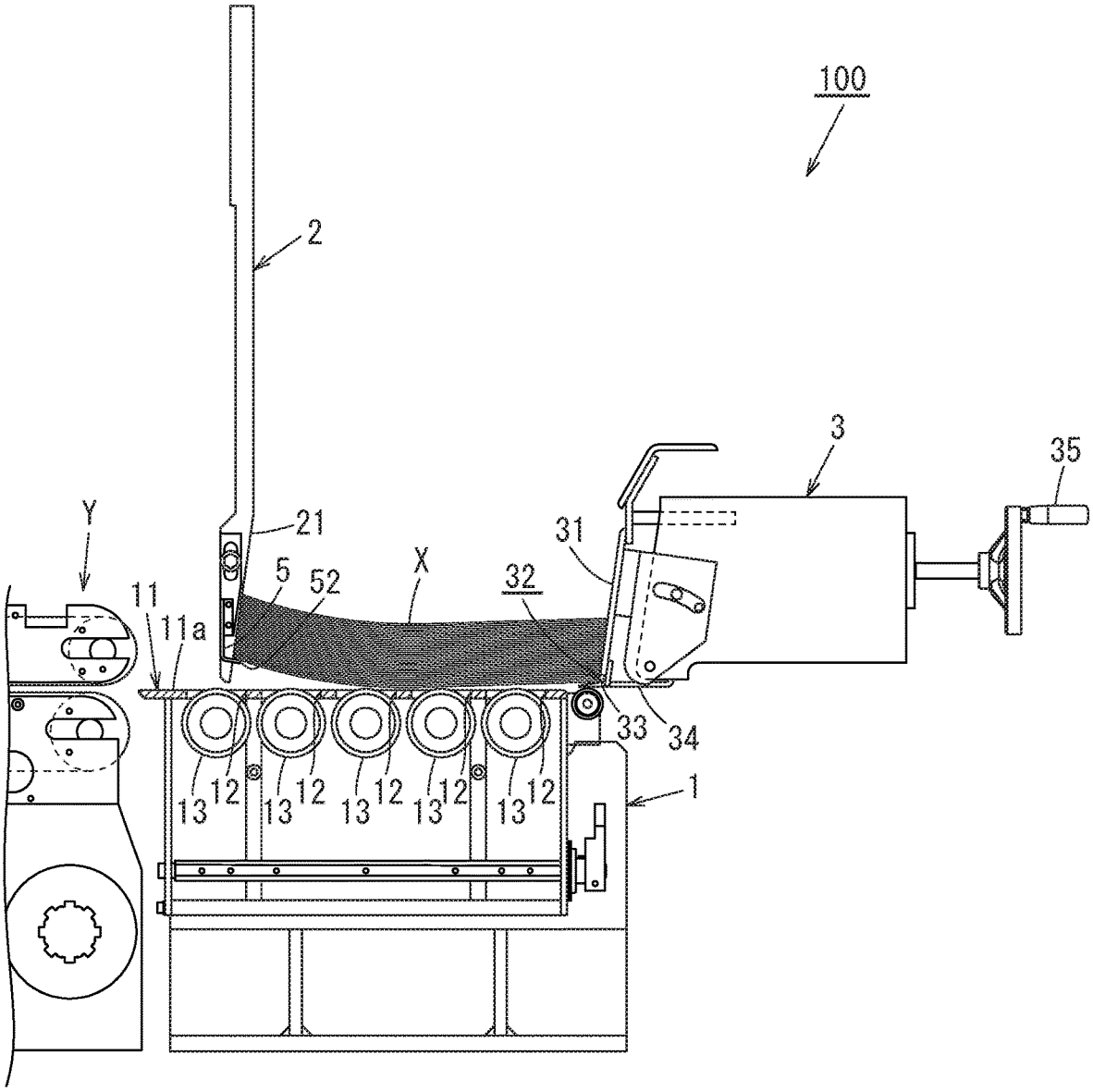
FIG. 1 is a side view showing a state where a paper feeding device according to one embodiment of present invention is used.

FIG. 1 shows a paper feeding device 100 according to a first embodiment of present invention. The paper feeding device 100 is used to feed paper sheets X, loaded in a thickness direction aligned with an up-down direction, in order from bottom to a next process device, such as a printing machine or a punching device, and mainly includes a paper feeding device body 1, a guide plate 2, and a back guide 3. Reference sign Y in FIG. 1 indicates a conveyor that conveys the paper sheet X to the next process device.

The paper feeding device body 1 includes a paper feeding table 11 having a horizontal plate shape, a suction hole 12 through which the paper sheet X to be fed is suctioned downward, a suction pump (not shown) that supplies a negative pressure to the suction hole 12, a plurality of paper feeding rolls (paper feeding conveyors) 13 that move the paper sheet X forward or rearward in a paper feeding direction, a servo motor (not shown) that rotationally drives the plurality of paper feeding rolls 13, and a control unit (not shown), and the paper feeding device body is configured to convey the paper sheet X loaded on an upper surface 11*a* of the paper feeding table 11 forward and rearward in the paper feeding direction.

Figure 2:
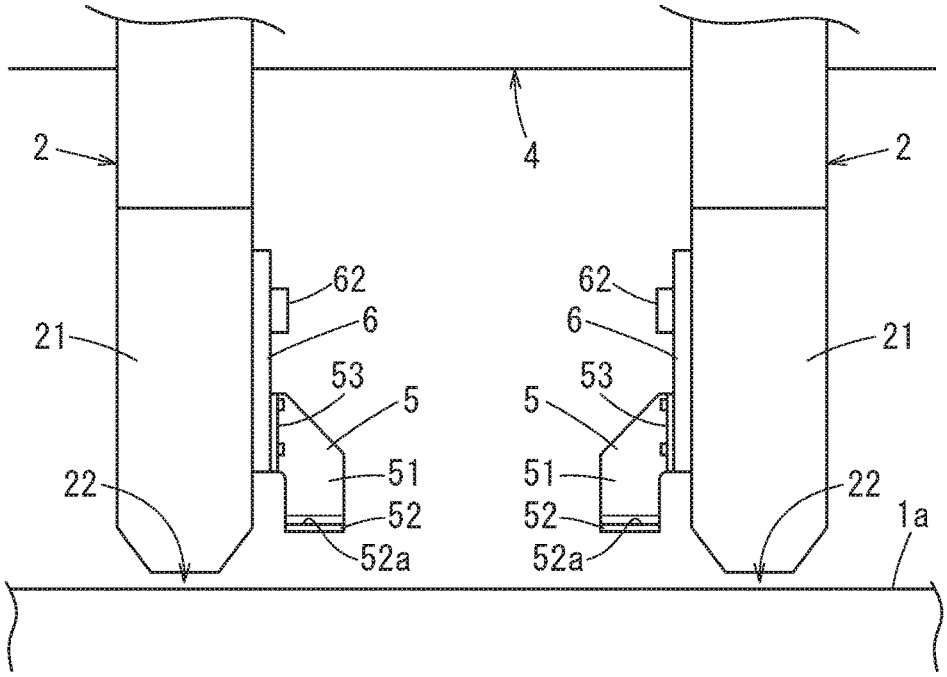
FIG. 2 is an enlarged front view of a main part showing a lower end portion of a guide plate in FIG. 1.
Figure 3:
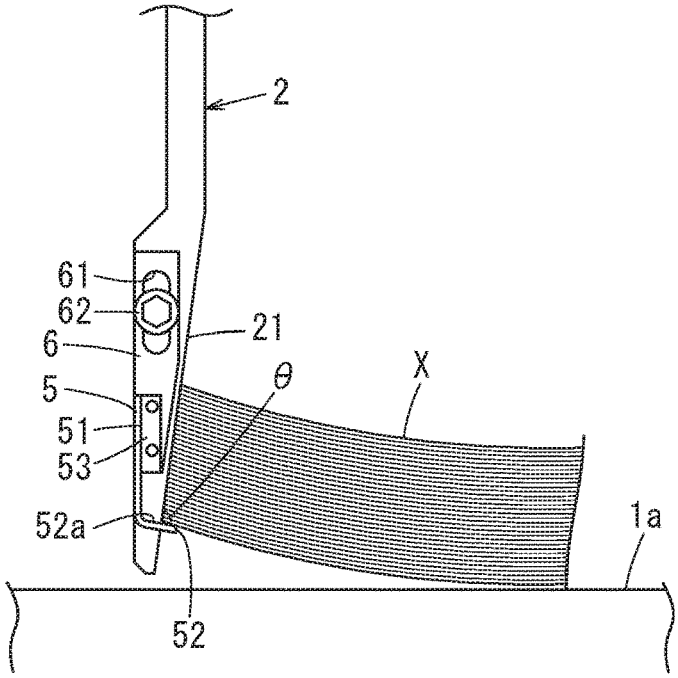
FIG. 3 is an enlarged side view of the main part showing the lower end portion of the guide plate in FIG. 1.

As shown in FIGS. 2 and 3, the guide plate 2 has a long plate shape, and is suspended from a crossbar 4 crossing above the paper feeding table in a plate thickness direction aligned with a paper feeding direction (away from a viewer of a paper surface in FIG. 2) above the upper surface ll*a* of the paper feeding table 11. On an upstream side surface of a lower end portion of the guide plate 2 in the paper feeding direction (on a side of the viewer of the paper surface in FIG. 2, a right surface in FIG. 3), a guide surface 21 having an upper side inclined to an upstream side in the paper feeding direction is provided.

For the guide plate 2, as shown in FIG. 2, two guide plates are spaced apart in a width direction of the paper feeding table 11, and the two guide plates 2 are provided so that a paper feeding gap 22 including a space between the guide plates and a gap between the guide plate and the paper feeding table 11 can be changed depending on a size or a thickness of the paper sheet X. The guide plate 2 includes a pair of left and right support hooks 5 and 5 that support a lower edge Xc of a front side of a bundle of stacked paper sheets X in a state where the lower edge is separated from the paper feeding table 11.

As shown in FIGS. 2 and 3, each support hook 5 is fixed, with screws, to an inner side surface of the guide plate 2 via a sliding plate 6. The support hook 5 is formed into an L-shape by bending a plate material, has a vertical portion 51 and a support piece 52 bent forward from the vertical portion 51, and is fixed to the sliding plate 6 with a screw portion 53 bent at right angles from a side of the vertical portion 51.

The sliding plate 6 is fixed to the side surface of the guide plate 2 with a hexagonal socket bolt 62 through a long hole 61 extending in the up-down direction. For the support hook 5, a height of the support piece 52 from the paper feeding table 11 is adjusted by loosening the hexagonal socket belt 62 and sliding the sliding plate 6 in the up-down direction. It is preferable that the support piece 52 has an upper surface 52*a* having a tip inclined downward, and it is particularly preferable that an angle □ between the upper surface and the guide surface 21 is 80 degrees or more and 100 degrees or less. Thereby, the paper sheet X to be fed easily comes off rearward.

Figure 4:
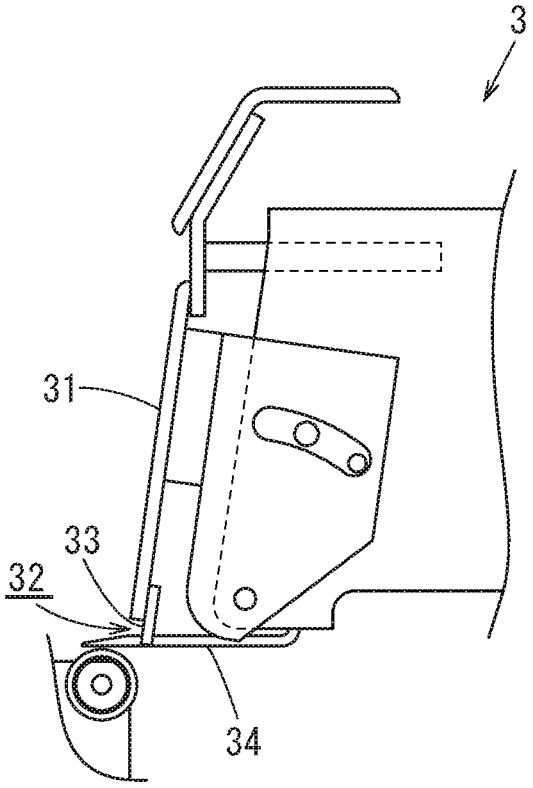
FIG. 4 is an enlarged side view of the main part showing a vicinity of a guide surface of a back guide in FIG. 1.

As shown in FIG. 4, the back guide 3 includes an abutting surface 31 that abuts on a trailing edge of each loaded paper sheet X, a paper trailing edge storing part 32 including a gap provided on a lower side of the abutting surface 31, a collision surface 33 provided behind the paper trailing edge storing part 32, a hook 34 that raises a trailing edge Xb of the bundle of loaded paper sheets X, and a manual handle 35 (see FIG. 1). The abutting surface 31 is provided to be movable forward and rearward with the manual handle 35. The abutting surface 31 is provided substantially parallel to the guide surface 21 of the guide plate 2 and has an upper side inclined rearward, and a size of the inclination can be changed.

Figure 5A:
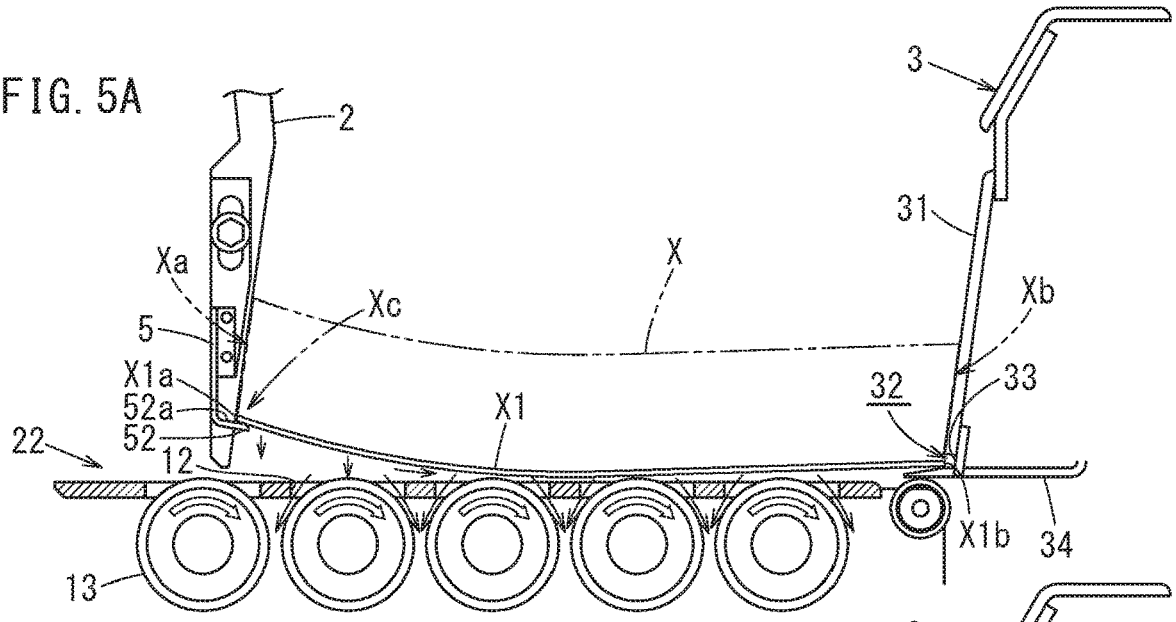
FIGS. 5A, 5B and 5C are explanatory views showing a behavior that a paper sheet is fed in the paper feeding device of FIG. 1.

When using the paper feeding device 100, as shown in FIG. 5A, first, the paper sheet is loaded between the guide plate 2 and the back guide 3 by allowing a leading edge Xa of the bundle of paper sheets X to abut on the guide surface 21, allowing the trailing edge Xb to abut on the abutting surface 31, and placing the lower edge Xc of the front side on the support piece 52 of the support hook 5.

Figure 5B:
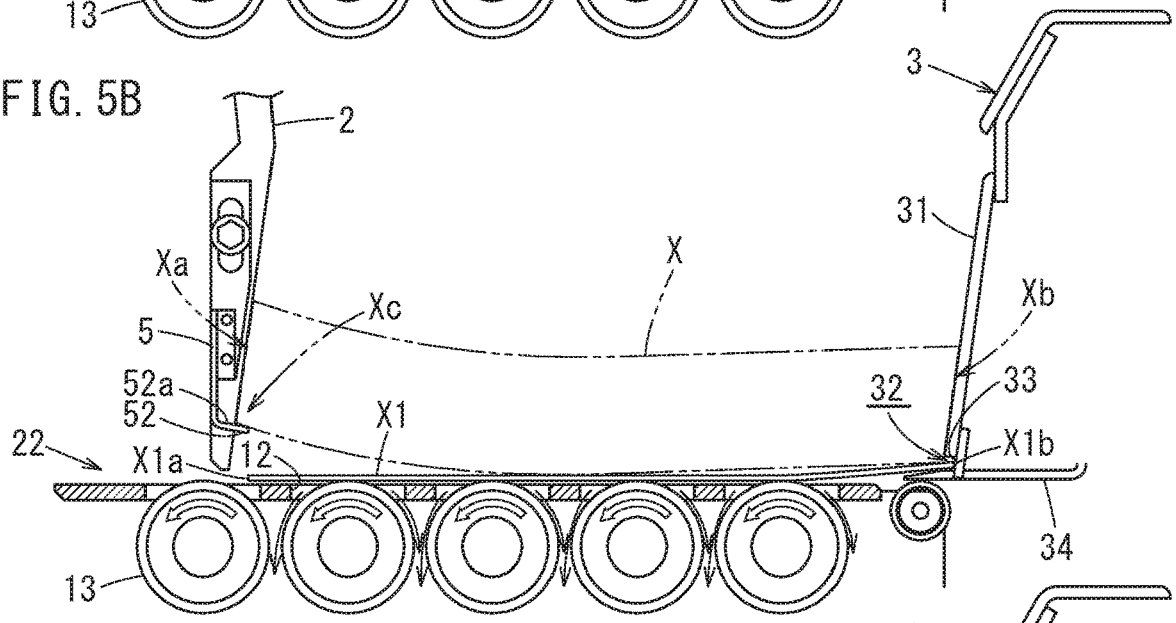

When a paper feeding start operation is performed on the paper feeding device 100 in this state, as shown in FIG. 5B, the operation includes operating the suction pump, suctioning a lowermost layer paper sheet X1 of the loaded paper sheets X through the suction hole 12, simultaneously operating the servo motor to roll the paper feeding roll 13 backward, and pulling out the lowermost layer paper sheet X1 rearward. The lowermost layer paper sheet X1 pulled out is retracted to withdraw a leading edge X1*a* from the support piece 52 and store a trailing edge X1*b* in the paper trailing edge storing part 32, and then collides with the collision surface 33. The suction pump keeps suctioning the paper sheet X with a constant pressure from when the paper feeding starts until the paper feeding ends.

Figure 5C:
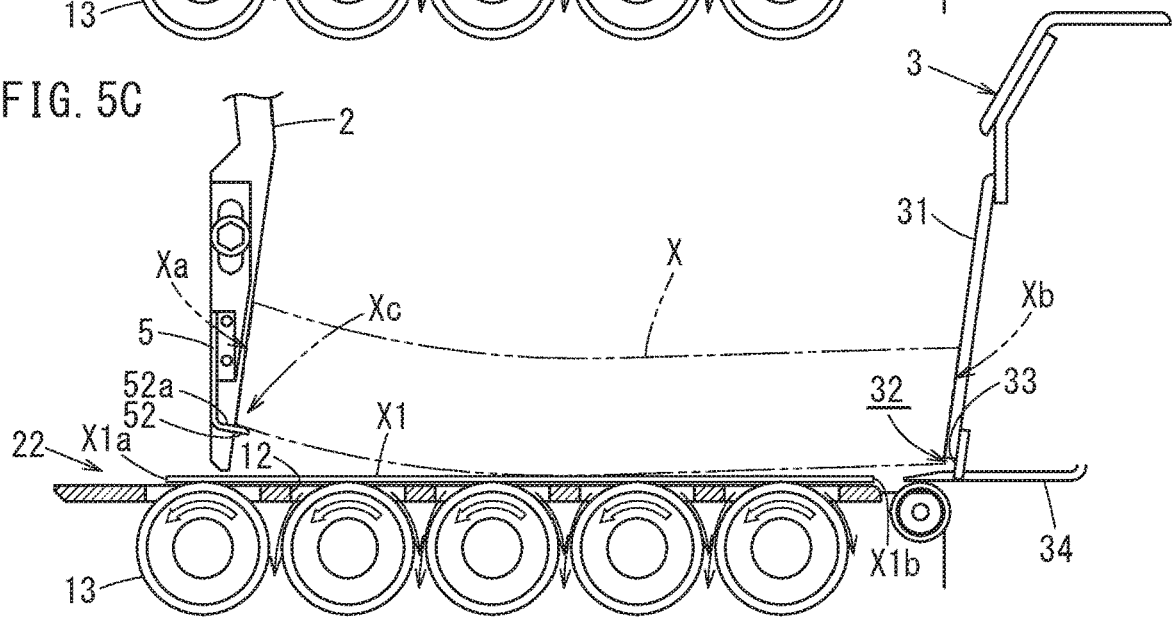
Figure 6:
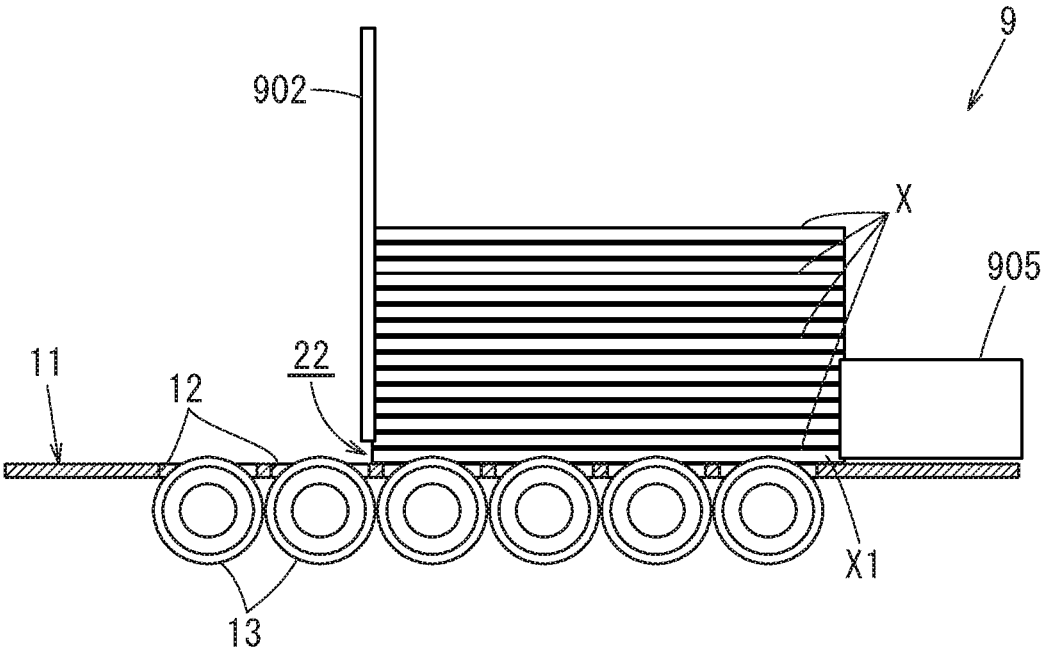
FIG. 6 is a side view showing a conventional paper feeding device.

When the lowermost layer paper sheet X1 collides with the collision surface 33, as shown in FIG. 5C, the servo motor and the paper feeding roll 13 are controlled to reverse, and the lowermost layer paper sheet X1 is advanced and transferred to the conveyor Y on a downstream side through the paper feeding gap 22.

As described above, the paper feeding device and paper feeding method of present invention are not limited to the above-described embodiment. For example, the number of the support pieces is not limited to two and may be one or three or more. The back guide does not have to include the collision surface. The paper feeding conveyer is not limited to the paper feeding roller and may be the belt conveyor including an endless annular belt. The support piece does not have to have the tip inclined downward, and the angle between the tip and the guide surface may be less than 80 degrees or in excess of 100 degrees. The guide surface does not have to be inclined.

While the invention has been particularly shown and described as referenced to the embodiments thereof, those skilled in the art will understand that the foregoing and other changes in form and detail may be made therein without departing from the spirit and scope.

What is claimed is:

1. A paper feeding device comprising:

a paper feeding table onto which a bundle of stacked paper sheets is loaded in a thickness direction aligned with an up-down direction;

a guide plate that is vertically provided above the paper feeding table, to abut on a leading edge of each paper sheet in the bundle;

a back guide comprising an abutting surface that abuts on a trailing edge of the paper sheets in the bundle;

a suction hole through which each loaded paper sheet on the paper feeding table is suctioned downward;

a suction pump that supplies a negative pressure to the suction hole;

a paper feeding conveyor comprised in the paper feeding table and comprising one of a paper feeding roll or a belt conveyor and moving each paper sheet loaded onto the table one of forward or rearward in a paper feeding direction;

a servo motor that rotationally drives the paper feeding conveyor;

a support piece that supports a lower edge of a front side of the bundle of the stacked paper sheets in a state where the lower edge is separated from the paper feeding table;

a paper trailing edge storing part comprising a gap provided between a lower end of the abutting surface of the back guide and the paper feeding table; and a control unit that controls the servo motor and the suction pump, wherein the control unit controls the servo motor and the suction pump to retract the paper sheet that is in a lowermost layer of the stacked paper sheets in the bundle so as to store a trailing edge of the lowermost layer paper sheet in the paper trailing edge storing part and then advance the lowermost layer paper sheet through the gap to feed the lowermost layer paper sheet to another device, while suctioning the lowermost layer paper sheet with the suction pump.

2. The paper feeding device according to claim 1, wherein the back guide comprises a collision surface provided behind the paper trailing edge storing part; and the control unit controls the servo motor so that the lowermost layer paper sheet sent rearward abuts on the collision surface and then the lowermost layer paper sheet is conveyed forward in the paper feeding direction.

3. The paper feeding device according to claim 1, wherein the support piece has a tip inclined downward.

4. The paper feeding device according to claim 1, wherein an angle θ between an upper surface of the support piece and a guide surface of the guide plate that abuts on a leading edge of one of the paper sheets is 80 degrees or more and 100 degrees or less.

5. A paper feeding method for feeding paper sheets, comprising:

loading paper sheets, wherein the paper sheets are loaded in a thickness direction aligned with an up-down direction, by use of a paper feeding device, the paper feeding device comprising: a paper feeding table onto which a bundle of the stacked paper sheets is loaded; a guide plate that is vertically provided above the paper feeding table, to abut on a leading edge of the paper sheets in the bundle; a back guide having an abutting surface that abuts on a trailing edge of the paper sheets in the bundle; a suction hole through which each loaded paper sheet is suctioned downward; a suction pump that supplies a negative pressure to the suction hole; a paper feeding conveyor comprised in the paper feeding table and comprising one of a paper feeding roll or a belt conveyor that moves each paper sheet loaded onto the table one of forward or rearward in a paper feeding direction; a servo motor that rotationally drives the paper feeding conveyor; a support piece that supports a lower edge of a front side of the bundle of the stacked paper sheets in a state where the lower edge is separated from the paper feeding table, and a paper trailing edge storing part comprising a gap provided between a lower end of the abutting surface of the back guide and the paper feeding table; and retracting, by the servo motor, the paper sheet that is in a lowermost layer of the stacked paper sheets in the bundle so as to store a trailing edge of the lowermost layer paper sheet in the paper trailing edge storing part, and then advancing the lowermost layer paper sheet through the gap to feed the lowermost layer paper sheet to the another device, while suctioning, by the suction pump, the lowermost layer paper sheet of the loaded paper sheets.

6. The paper feeding method according to claim 5, wherein in the paper feeding device, the back guide comprises a collision surface provided behind the paper trailing edge storing part, the servo motor allows the lowermost layer paper sheet sent rearward to abut on the collision surface, and then the servo motor conveys the lowermost layer paper sheet forward in the paper feeding direction.

* * * * *